US007125456B2

(12) United States Patent
Leufgens

(10) Patent No.: US 7,125,456 B2
(45) Date of Patent: Oct. 24, 2006

(54) METHOD FOR CLEANING A WASHING DEVICE OF AN OFFSET PRINTING MACHINE

(76) Inventor: Hermann Leufgens, Bauschenberg 59, Stolberg (DE) 52223

( * ) Notice: Subject to any disclaimer, the term of this patent is extended or adjusted under 35 U.S.C. 154(b) by 4 days.

(21) Appl. No.: 10/505,821

(22) PCT Filed: Mar. 24, 2003

(86) PCT No.: PCT/EP03/03040

§ 371 (c)(1),
(2), (4) Date: Aug. 25, 2004

(87) PCT Pub. No.: WO03/080343

PCT Pub. Date: Oct. 2, 2003

(65) Prior Publication Data

US 2005/0103361 A1 May 19, 2005

(30) Foreign Application Priority Data

Mar. 27, 2002 (DE) ..... 102 13 647

(51) Int. Cl.
*B08B 3/12* (2006.01)

(52) U.S. Cl. ..... 134/1; 134/26; 134/29; 134/34; 134/36; 134/104.1; 134/184; 134/186

(58) Field of Classification Search ..... 134/1, 134/26, 29, 104.1, 184, 186, 34, 36
See application file for complete search history.

(56) References Cited

U.S. PATENT DOCUMENTS 4,849,769 A * 7/1989 Dressler ..... 347/27
5,291,827 A * 3/1994 Liers et al. ..... 101/424
6,308,627 B1 10/2001 König

FOREIGN PATENT DOCUMENTS

DE 37 44 800 A1 6/1989
EP 0 903 230 A2 7/1998

* cited by examiner

*Primary Examiner*—Zeinab El-Arini
(74) *Attorney, Agent, or Firm*—Cohen, Pontani, Lieberman & Pavane

(57) ABSTRACT

The invention relates to a method for cleaning a washing device (5) of an offset printing machine, according to which at least one washing device of said offset machine, which comprises a spray bar (11), is removed prior to the cleaning process and placed in a cleaning bath (17). The aim of the invention is to achieve improved cleaning results in a shorter time, in particular using fewer personnel. To achieve this, ultrasonic waves are directed onto the washing device in the cleaning bath that is filled with a liquid medium and during the cleaning of the washing device using said ultrasonic waves, the liquid medium is conducted through each spray bar. The invention also relates to a cleaning device (16) for carrying out said method.

12 Claims, 6 Drawing Sheets

METHOD FOR CLEANING A WASHING DEVICE OF AN OFFSET PRINTING MACHINE

This is a U.S. national stage of application No. PCT/EP03/03040, filed on Mar. 24, 2003. Priority is claimed on that application and on the following application. Country: Germany, Application No.: 102 13 647.5, Filed: Mar. 27, 2002.

BACKGROUND OF THE INVENTION

1. Field of the Invention

The invention pertains to a method for cleaning a washing device of an offset printing machine, in which the washing device of the offset printing machine, which has at least one spray bar, is removed before cleaning and introduced into a cleaning device. In addition, the invention pertains to a cleaning device for implementing the method. Known washing devices in offset printing machines include the rubber blanket washing device and the counterpressure washing device.

2. Description of the Related Art

An offset printing machine is used to print sheets and usually has several printing mechanisms, from which the printed sheets are sent via a conveyor to a delivery stack. Each printing mechanism consists in the manner known in and of itself of a plate cylinder, to which an inking mechanism and a moistening mechanism are assigned; a rubber blanket cylinder; and a printing cylinder. A washing device for the rubber blanket is assigned to the rubber blanket cylinder, this device being located before—with respect to the cylinder's direction of rotation—the contact point with the printing cylinder. This rubber blanket washing device serves to wash the rubber blanket after a certain number of impressions to remove ink residues, paper dust, and other dirt particles.

Permanently installed rubber blanket washing devices are subject to wear and are relatively complicated to maintain and to clean. For this reason, rubber blanket washing devices were developed which can be removed as a unit from the printing machine and cleaned and maintained outside the printing machine. A process for the easy removal and reinstallation of rubber blanket washing devices is disclosed in U.S. Pat. No. 6,308,627.

An example of removable rubber blanket washing device is described in DE 37 44 800 A1. This device consists essentially of a wiping cloth, which can be pressed against the rubber blanket cylinder. The wiping cloth, which can be moistened by a moistening device, can be unwound from a first winding shaft and then wound up on second winding shaft after use.

Modern washing devices which can be laid against the rubber blanket of the blanket cylinder have at least one brush roll, to which water and washing liquid can be supplied by spraying devices. A collecting tank is provided underneath the brush roll.

According to the state of the art, these types of blanket washing devices are cleaned by first removing the unit comprising the blanket washing device from the printing machine, by disassembling it into its essential components, and by cleaning these components in a cleaning tank with flat fine-bristle brushes and coarse-bristle brushes and conventional cleaning agents. These manual cleaning processes make it possible to clean the rubber blanket washing device satisfactorily.

The problem, however, is the large amount of time which this process requires, namely, about 3–4 hours. This time adds up especially in the case of the large, multicolor printing machines with numerous printing mechanisms, each with its own rubber blanket washing device.

The cleaning of the spray bars of modern rubber blanket washing machines, which are provided near the brush rolls to supply the water and cleaning agent, also presents problems. When the rubber blanket washing device is put into operation, it is impossible to prevent small quantities of ink residues, paper dust, and powder from getting into the inside of the spray bars and adhering to the inside walls. The attempt has been made to rinse out the sensitive spray bars with water or compressed air. The cleaning results, however, have been unsatisfactory for the most part. The cleaning efficiency of the rubber blanket washing device, however, depends to a large degree on the satisfactory function of the spray bars.

A process for removing the stencil coatings of screen-printing forms is also known from EP 0 903 230 A2. The screen-printing form along with the stencil carrier is immersed in a liquid bath and decoated by an ultrasound device. The ultrasound device is placed against the stencil carrier, so that there is direct contact between the ultrasound device and the screen-printing form.

Finally, a cleaning tank for the ultrasonic cleaning of printing cylinders of various sizes is known from U.S. Pat. No. 5,291,827. The printing cylinder is rotated continuously in the cleaning liquid as it is being cleaned. The ultrasonic waves have power of about 2,400 watts and a frequency of 27 kHz.

SUMMARY OF THE INVENTION

Proceeding from this state of the art, the invention is based on the task of creating a cleaning process for washing devices, especially rubber blanket washing devices which can be removed from the printing machine, which process offers improved cleaning results in a shorter time and especially with fewer personnel, and which also ensures that the spray bars function properly. Finally, a device suitable for carrying out the process is also to be created.

This task is accomplished in a process of the type described above in that:

ultrasonic waves are directed onto the washing device in the cleaning tank, which is filled with a liquid medium; and in that during the cleaning of the washing device by means of ultrasonic waves, the liquid medium is conveyed through each of the spray bars.

As previously mentioned, modern washing devices have spray bars to supply water and cleaning agent to the area of the brush rolls. To improve the problematic cleaning of the interior of the spray bars, it is proposed according to the invention that, during the cleaning of the washing device by means of ultrasonic waves, the liquid medium be conveyed through the spray bars. This can be done, for example, by connecting the inlets of the hollow cylindrical spray bars by hoses to a pump, which transports the liquid medium through the spray bars during the ultrasonic cleaning.

The ultrasonic waves cause so-called "cavitation" to occur in the liquid medium. In addition to dust and dirt particles, the surfaces of the components immersed in the liquid medium also act as cavitation nuclei. The dirt particles are exploded off these surfaces and become suspended in the liquid medium. The inventive cleaning by means of ultrasonic waves shortens the cleaning time to approximately 0.5–2 hours. It should be emphasized that the special advantage of the process is that no personnel are tied up during the actual cleaning operation itself. It is impossible for any damage to occur to the rubber blanket washing device or to the cleaning equipment. The ultrasonic waves also clean areas of the rubber blanket washing devices which are difficult to reach.

The cleaning results can be improved even more by disassembling the washing device at least partially into its components before it is placed in the cleaning tank and subjected to the ultrasonic waves. This disassembly step, however, is not absolutely necessary, because the ultrasonic waves will act even on areas of the rubber blanket washing device which are covered by other components.

Because ultrasonic cleaning requires sound waves of a certain power, it should preferably be carried at an ultrasonic wave frequency in the range of 16–100 kHz and at an ultrasonic intensity of at least 2 W/L of liquid medium in the cleaning tank. In cases of especially dirty washing devices, the power can be increased to 10 W/L of liquid medium in the cleaning tank.

The cleaning results can be improved even more by directing the ultrasonic waves onto the washing device from at least two different directions.

The ultrasonic waves heat the liquid medium. To prevent the liquid medium from being heated to a temperature beyond its boiling point and thus to prevent it from evaporating, an embodiment of the inventive process provides that the liquid medium in the cleaning tank is cooled.

To facilitate the handling of the washing device—whether disassembled or as a unit—it is proposed in an embodiment of the invention that the washing device be introduced into the cleaning tank by a carrier such as a wire basket for the items to be cleaned.

After it has been cleaned, the washing device, possibly with the help of the carrier for the items to be cleaned, is removed from the cleaning tank, dried, and reinstalled in the offset printing machine. If the cleaning process cannot be conducted during a pause in the operation of the offset printing machine which has proven to be operationally necessary for some other reason, a rubber blanket washing device of the same design can be kept on hand as a spare.

Suitable liquid media for the inventive cleaning process include, in particular, standard commercial mixtures of dearomatized, aliphatic hydrocarbons; emulsifiers; solubilizers, especially those based on esters; and corrosion inhibitors. To shorten the cleaning times, it also possible to use more aggressive cleaning agents, especially alkaline ones.

A cleaning device for implementing the process is characterized in that at least one ultrasound head is mounted on the cleaning tank, and in that the cleaning device has a flushing system, which can be connected to the spray bars. Each ultrasound head can be designed, for example, as an immersible transducer, as a vibrating plate, or as a cylindrical transducer. The ultrasound heads are attached to the cleaning tank by hooks or fastening tabs, or they can be fastened directly to a wall of the cleaning tank by screws or welds.

So that the cleaning tank can accommodate a rubber blanket washing device, it can have inside dimensions of, for example, 1,200×300×300 mm (length×width×depth).

So that the ultrasonic waves can be directed from two directions onto the washing device, the cleaning device in one embodiment of the invention has at least two ultrasound heads on opposite sidewalls of the cleaning tank.

The intensity and duration of the ultrasonic waves can be adjusted by connecting the ultrasound generators to a power control unit and/or to a timer.

A device for monitoring the level of liquid in the tank will prevent the ultrasound heads and the pumps from running when dry. Pumps are installed in the cleaning device to flush the spray bars but also automatically to fill the cleaning device with liquid medium and to empty it again.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

In the drawings:

DETAILED DESCRIPTION OF THE PRESENTLY PREFERRED EMBODIMENTS

Figure 1:
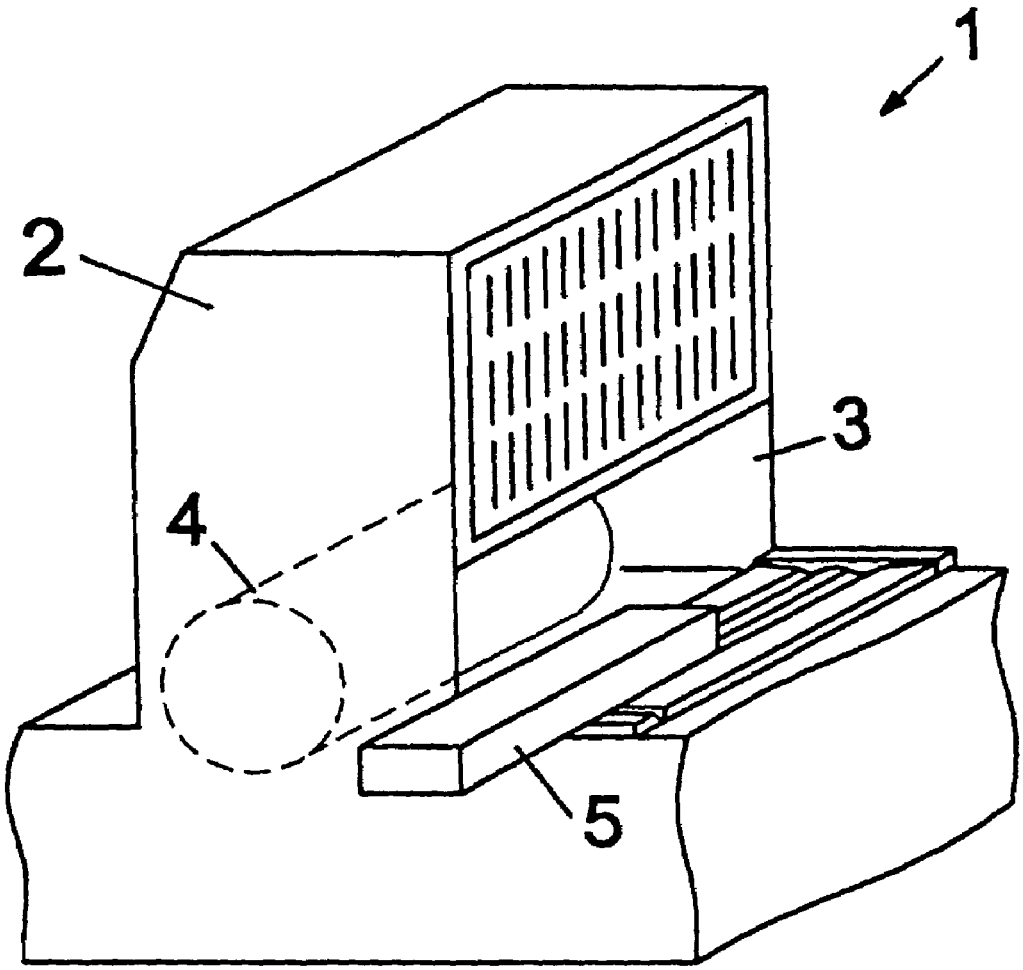
FIG. 1 shows a schematic diagram of a printing mechanism with removable rubber blanket washing device.

FIG. 1 shows an offset printing machine 1, the printing mechanism of which has two end walls 2 and 3, between which a rubber blanket cylinder 4 is rotatably supported.

Upstream, relative to the direction of rotation, of the contact point with a printing cylinder (not shown), a washing device 5 for the rubber blanket is assigned to the rubber blanket cylinder 4.

Figure 2:
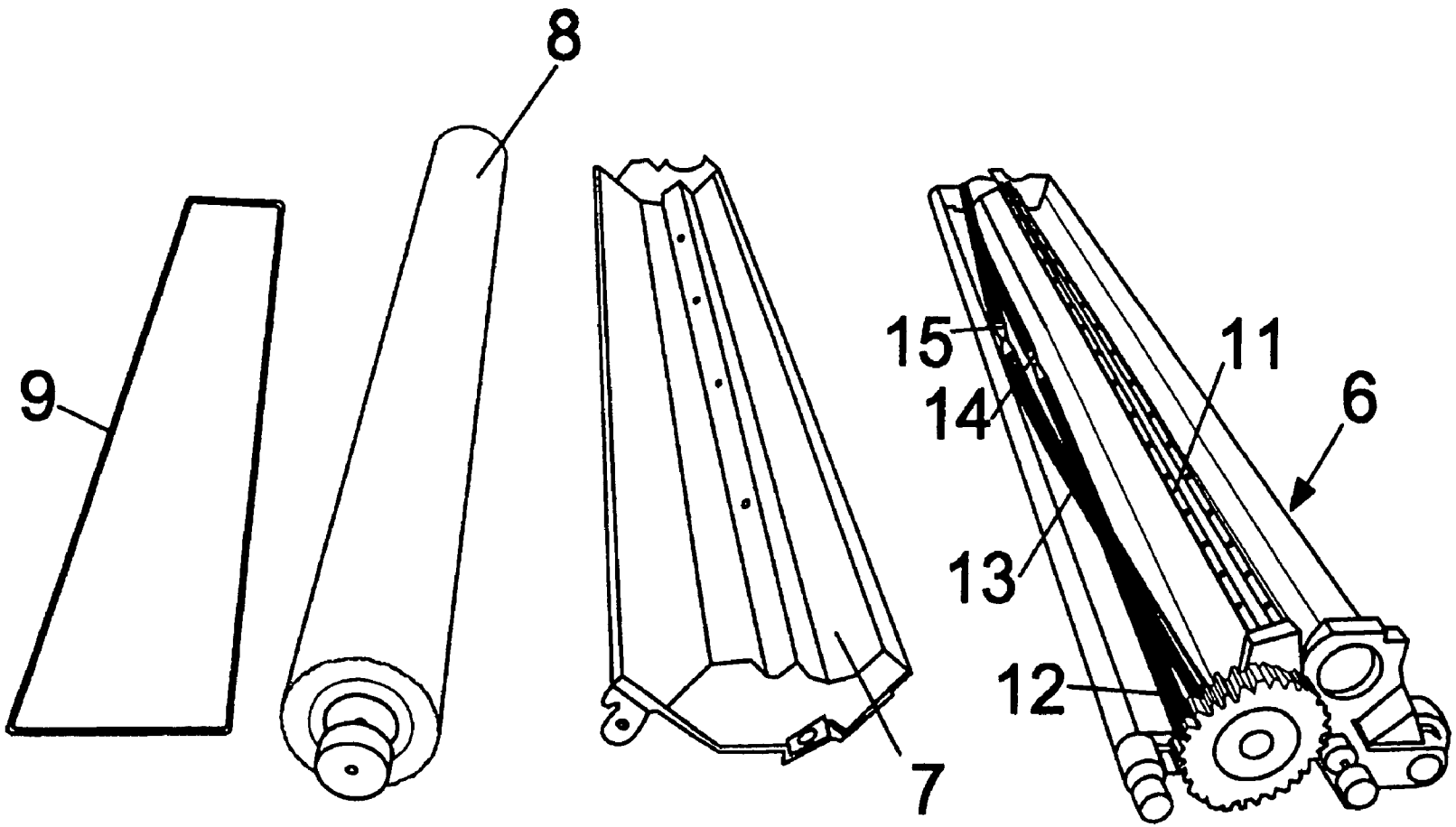
FIG. 2 shows a rubber blanket washing device according to FIG. 1 partially disassembled into its components.
Figure 3:
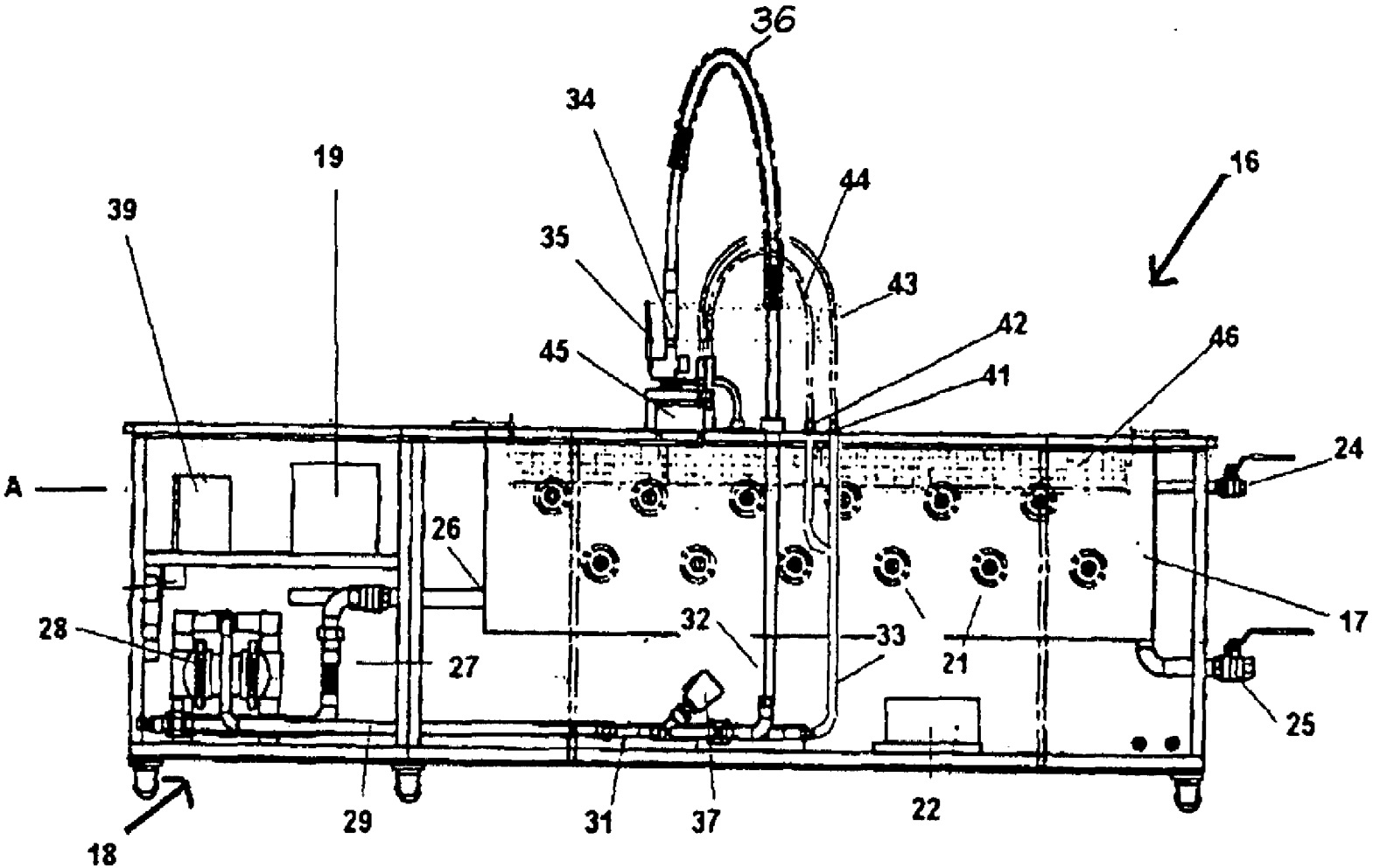
FIG. 3 shows a front view of the cleaning device after removal of the cover.
Figure 4:
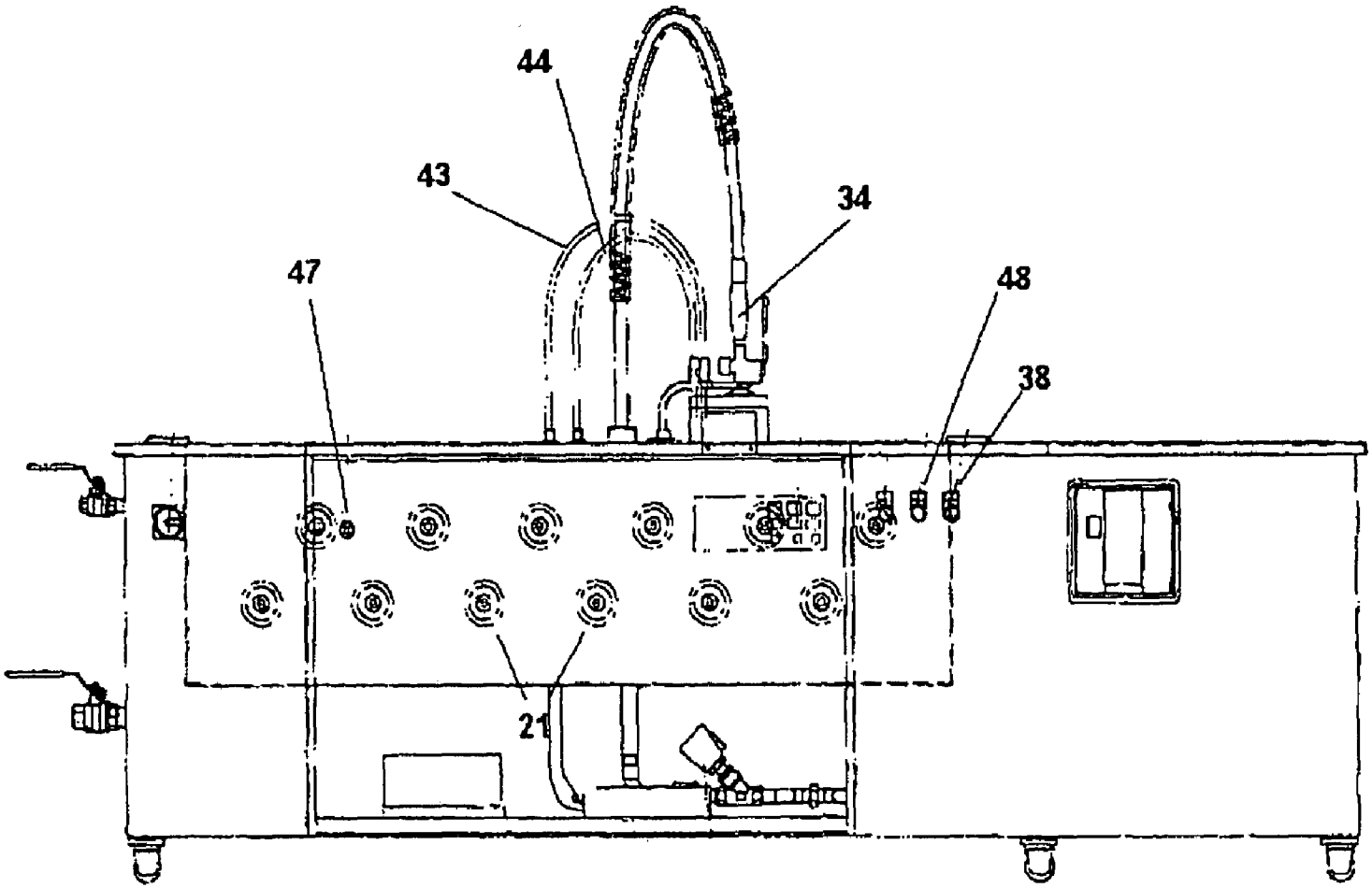
FIG. 4 shows a rear view of the cleaning device after removal of the cover.
Figure 5:
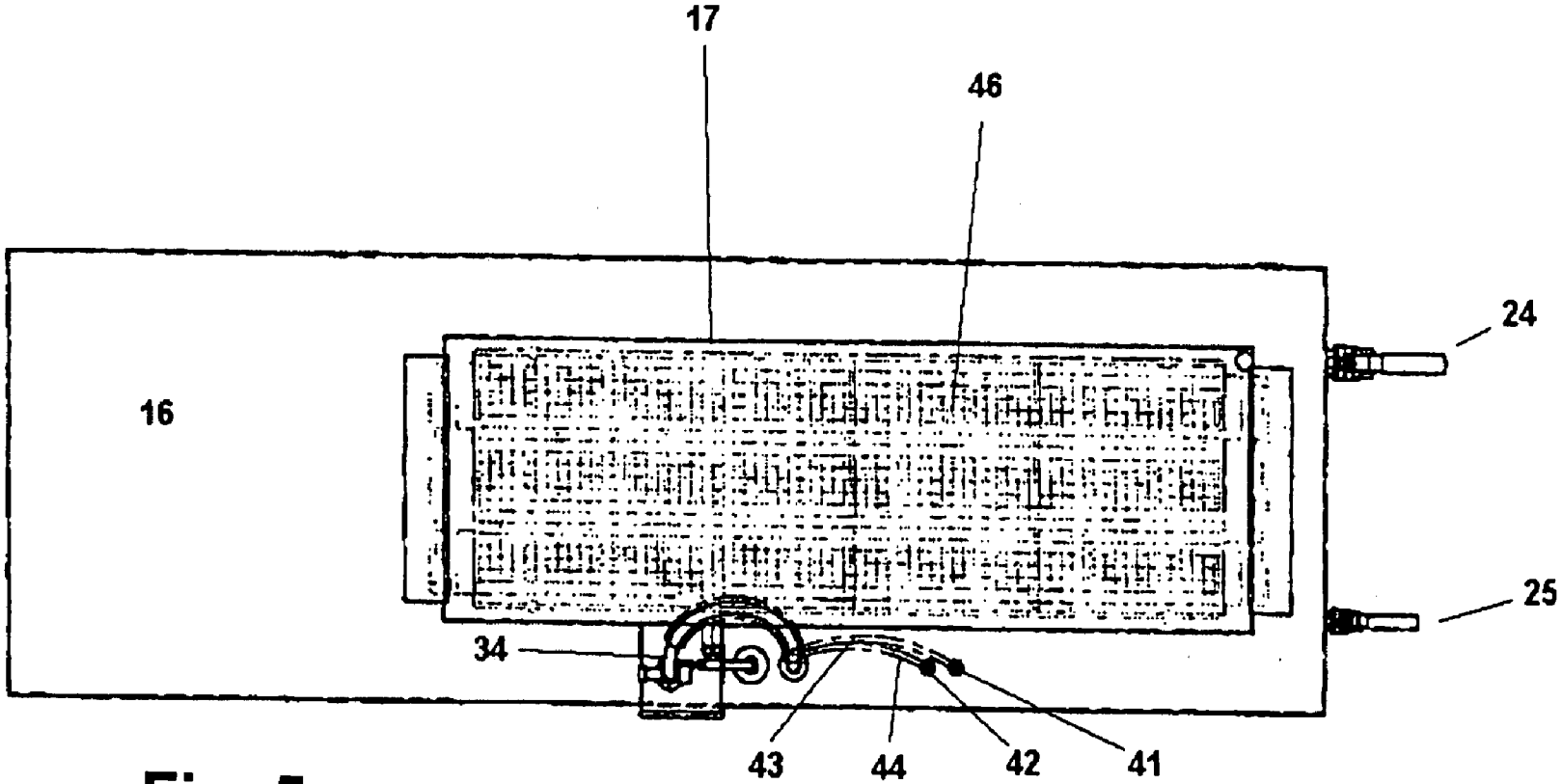
FIG. 5 shows a top view of the cleaning device.
Figure 6:
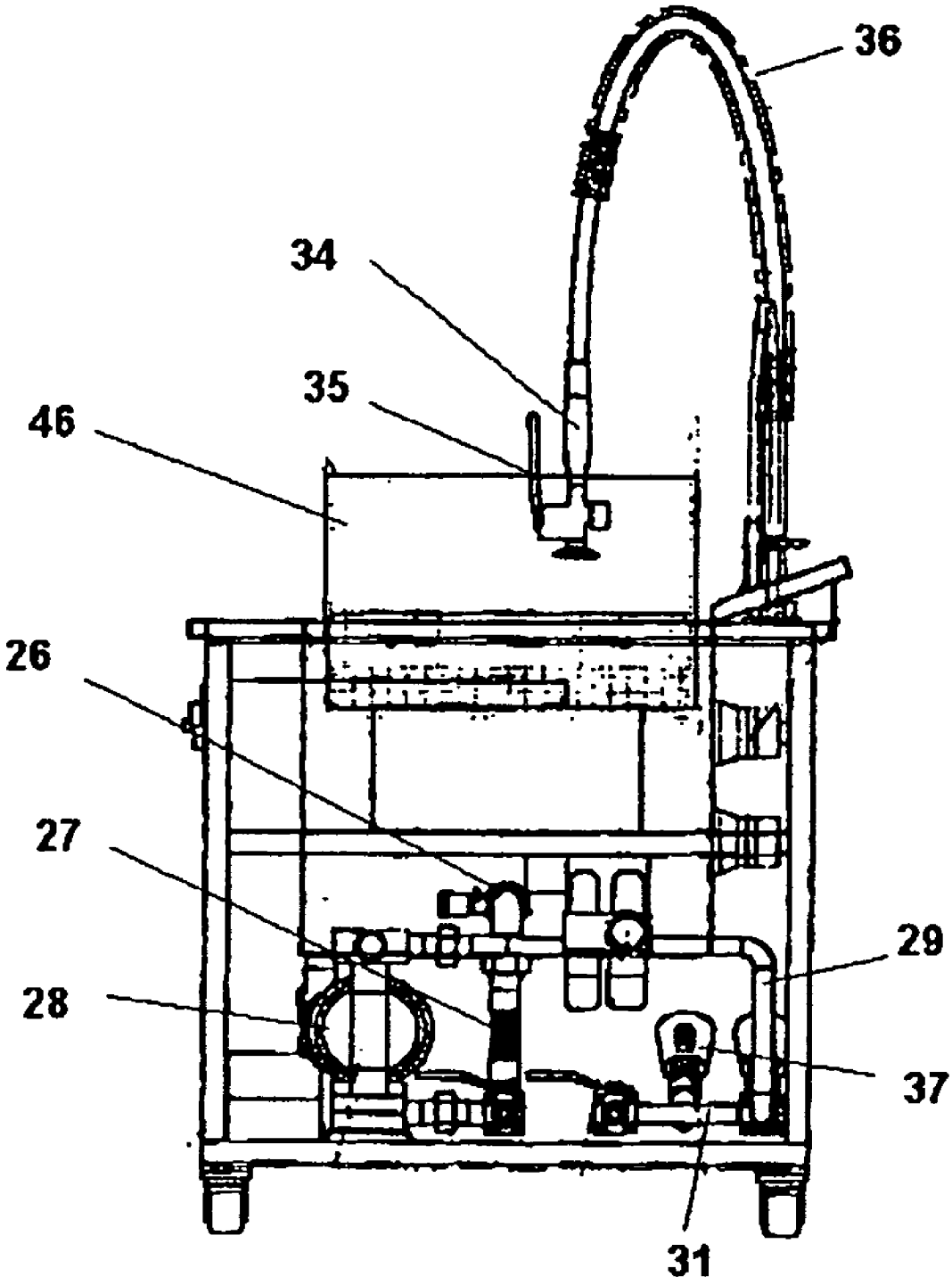
FIG. 6 shows an end view of the cleaning device after removal of the cover, looking in the direction indicated at "A" in FIG. 3.

So that it can be cleaned, the rubber blanket washing device 5 is removed from the printing machine 1 and partially disassembled. FIG. 2 shows a rubber blanket washing device 5 of the type used in modern offset printing machines after it has been disassembled into four parts. The rubber blanket washing device consists essentially of a brush roll 8, spray bars 11 with a plurality of flushing openings for cleaning agent and water, a collecting tank 7, and a base 6, which has a gearbox for driving the brush roll. A seal 9 can also be seen, which is installed between the base 6 and the collecting tank 7. In the assembled state of the rubber blanket washing device, the spray bars 11 work together with the brush roll 8. The spray bars 11 are supplied with water and cleaning agent via hoses 12, 13; the water and cleaning agent are supplied to the brush roll during the operation of the rubber blanket washing device. The hoses 12, 13 have connectors 14, 15.

The rubber blanket washing device 5, disassembled as shown in FIG. 2, is placed in a cleaning device, 16, which is explained in greater detail on the basis of FIGS. 3–6.

The cleaning device 16 consists essentially of a cleaning tank 17, a flushing system 18, and an ultrasound generator 19. Ultrasound heads 21, arranged in two offset rows, are provided on opposite sidewalls of the cleaning tank 17. These heads are oscillated by the ultrasound generator 19.

Heating elements (not shown), which are connected to a heating control unit 22, are installed at the bottom of the cleaning tank 17. The heating control unit 22 has a temperature sensor, which detects the temperature of the liquid medium in the cleaning tank 17. The liquid medium is brought to operating temperature by the heating elements. As soon as the operating temperature is reached, a feedback signal is sent to the heating control unit 22 by the temperature sensor to prevent the liquid medium from being heated any further.

At the right end wall, the cleaning tank 17 has a feed port 24 and a discharge port 25 for the liquid medium. In the opposite end wall of the cleaning tank, there is a second discharge port 26, which is connected by a pipe 27 to the suction side of a diaphragm pump 28. Another pipe 29, which splits at a branching point 31 into the flushing pipes 32, 33, is connected to the delivery side of the diaphragm pump 28. The flushing pipe 32 leaves the top of the housing of the cleaning device 16 and opens into a hose 36, which is connected to a hand sprayer 34 with an actuating lever 35. In the flow path of the flushing pipe 32 there is also an electrically actuated valve 37, which can be opened by a push button 38 and a control unit 39.

In its further course, the flushing pipe 33 branches and leads to two connectors 41, 42, which are connected to the flushing hoses 43, 44. The ends of the flushing hoses 43, 44 can be inserted into a holder 45 when the hoses are out of service.

When a rubber blanket washing device 5 is to be cleaned, it is first disassembled before it is introduced by the dirty-item carrier 46 into the cleaning tank 17. The hoses 12, 13 of the rubber blanket washing device 5 are pulled off the connectors 14, 15 (see FIG. 2) and connected to the flushing hoses 43, 44 by means of quick-release hose connectors. Then the carrier 46 containing the components of the rubber blanket washing device and the connected flushing hoses is immersed in the liquid medium in the cleaning tank 17. A level sensor 47 ensures that the liquid medium does not fall below a defined level. If the level sensor 47 sends a signal indicating that the liquid level is too low, liquid medium is automatically supplied via the feed port 24.

After the rubber blanket washing device has been immersed in the liquid medium, the ultrasound generator 19 is turned on, so that the ultrasonic waves produced by the ultrasound heads 21 can exert their effect on the components of the rubber blanket washing device. At the same time or possibly after a certain delay, a push button 48 connected to the control unit 39 is used to turn on the diaphragm pump 28 and thus to activate the flushing system 18. The flushing system allows the diaphragm pump 28 to convey the liquid medium through the spray bars, while ultrasonic waves are directed at the components of the rubber blanket washing device. As a result, the interior of the spray bars 11 is given a thorough cleaning, which is of crucial importance to the success of the cleaning operation and thus to the operational reliability of the rubber blanket washing device.

An additional manual cleaning of individual components of the rubber blanket washing device can be conducted by opening the valve 37 and using the hand sprayer 34.

The area of application of the inventive cleaning device 16 is not limited to the cleaning of rubber blanket washing devices but rather extends to all washing devices of offset printing machines which have at least one spray bar.

Upon conclusion of the cleaning process, the carrier 46 for the items to be cleaned is removed from the liquid medium and placed on supports on top of the cleaning device 16. The components of the rubber blanket washing machine are then reassembled, and the device is installed in the printing machine.

The invention is not limited by the embodiments described above which are presented as examples only but can be modified in various ways within the scope of protection defined by the appended patent claims.

I claim:

1. A method for cleaning a washing device of an offset printing machine, the washing device having at least one spray bar, the method comprising:

removing the washing device from the printing machine;

placing the washing device in a liquid medium in a cleaning tank;

directing ultrasonic waves at the washing device in the liquid medium; and conveying the liquid medium through each said spray bar while the ultrasonic waves are being directed at the washing device.

2. A method as in claim 1 wherein the ultrasonic waves have a frequency in the range of 16–100kHz.

3. A method as in claim 1 wherein the ultrasonic waves have an intensity of at least 2 watts/liter of liquid medium.

4. A method as in claim 1 further comprising at least partially disassembling the washing device before placing the washing device in the liquid medium.

5. A method as in claim 1 wherein the ultrasonic waves are directed at the washing device from different directions.

6. A method as in claim 1 further comprising cooling the liquid medium in the cleaning tank.

7. A method as in claim 1 further comprising placing the washing device in a carrier for items to be cleaned before placing the washing device in the liquid medium.

8. A method as in claim 1 wherein the liquid medium comprises aliphatic hydrocarbons, emulsifiers, solubilizers, and corrosion inhibitors.

9. A method as in claim 1 wherein the liquid medium comprises an alkaline cleaning agent.

10. A method as in claim 1 wherein the ultrasonic waves are directed at the cleaning device for at least 20 minutes.

11. A method as in claim 1 further comprising:

removing the washing device from the liquid medium in the cleaning tank;

drying the washing device; and reinstalling the washing device in the offset printing machine.

12. A method as in claim 1 further comprising:

connecting a flushing system to each said spray bar; and pumping the liquid medium to each said spray bar via said flushing system, whereby the liquid medium is conveyed through the spray bars.

* * * * *